US005522182A

United States Patent [19]

Rogers

[11] Patent Number: 5,522,182

[45] Date of Patent: Jun. 4, 1996

[54] STADIUM SEATING

[76] Inventor: Jesse Rogers, P.O. Box 509, Estill Springs, Tenn. 37330

[21] Appl. No.: 206,090

[22] Filed: Mar. 4, 1994

[51] Int. Cl.[6] ..... E04A 3/12

[52] U.S. Cl. ..... 52/9; 297/344.1; 297/440.14

[58] Field of Search ..... 52/8, 9; 297/340, 297/349.1, 344.11, 325, 344.1, 440.14, 440.15, 452.11

[56] References Cited

U.S. PATENT DOCUMENTS 331,634 12/1885 Hall ..... 297/325 X

*Primary Examiner*—Creighton Smith

*Attorney, Agent, or Firm*—Rick R. Wascher; Laura K. Thomas; Wascher & Thomas

[57] ABSTRACT

The present invention is directed to stadium seating and stadiums incorporating the seating. The invention includes a unitary seat component having a platform seat portion and a back portion formed integrally with one another. The invention also includes a side support which is configured with a arcuate flange receiving channel enabling the seat component of the invention to be installed to the side component. In this fashion, spaced apart side components are useful for attaching a plurality of seats such that a seat is positioned between a pair of side supports and a side support positioned between adjacent seats is shared as a common armrest for each adjacent seat. A channel and track structure is provided to anchor the sides to the stadium or platform floor in the desired fashion.

20 Claims, 8 Drawing Sheets

STADIUM SEATING

BACKGROUND OF THE INVENTION

1. Field of the Invention

The present invention relates generally to chairs and seats, but more particularly to the type of seating found in stadiums, amphitheaters, arenas, baseball parks, concert facilities, and movie houses, to name a few (hereinafter collectively referred to as "stadiums"). A typical stadium includes an event area, and a plurality of substantially uniform rows of spectator seats grouped together to form sections. The rows of seats in a given section are usually bounded by a wide aisle capable of accommodating the passage of several individuals moving about between sections, and separated by a narrow passageway. The width of the passageway generally corresponds to the amount of exposed floor or ground space between a seat of one row and the back of the seating of an adjacent row.

2. Description of the Related Art

The art to which the invention relates includes stadium seating having a seat component, a back component, and a pair of spaced apart sides. The typical arrangement of stadium seating incorporates a fixed back component with a pivotally mounted seat component.

The pivotally mounted seat component provides a means to raise the seat in an upward direction to prevent the accumulation of rain water, snow, sleet, and the like when the seating is used outdoors. In addition, the pivotal design prevents other matter, such as spilled popcorn, soda, and other edible articles from collecting thereon.

Pivotally mounted seat components are particularly useful when the passageway between rows is narrow, because a narrow passageway is not easily traversed by an individual attempting to leave or take a seat positioned off an aisle and somewhere in the middle of a particular row.

Conventional stadium seating is often constructed of a plurality of spaced apart slats. The slats prevent fluids and other matter from accumulating on the seat. The slats, however, are not particularly comfortable and have been known to catch or pinch skin, and allow clothing and other articles to become caught between adjacent slats.

The seating comprising the art to which the invention relates also includes seating that is anchored to a series of pedestals, or other framework and has a back portion integral with a seat portion. Such rigidly mounted seating does not allow the user to raise or lower the seat to accommodate passers-by.

Accordingly, one common drawback associated with conventional stadium seating is the lack of an integral, unitary seat and back which is capable of being moved out of the passageway between rows. Another common drawback associated with all pivotally mounted seats is the frequency with which skin, clothing and other articles is pinched or caught in the slats or pivot structure of the seating.

Until now, a unitary stadium seat capable of engaging spaced apart side supports, or similarly configured framework forming an armrest, yet remain in an operable user supporting position and capable of minimizing the accumulation of matter thereon when the seating is not in use, has not been invented.

SUMMARY OF THE INVENTION

The present invention is directed to stadium seating and a stadium incorporating the inventive seating. The seating can be summarized in variety of ways, including: stadium seating including a seat having an integral back, a flange; and spaced apart sides having a channel; means for anchoring the combination of the seat and pair of spaced apart sides to a ground surface; wherein the flange and the channel are cooperatively configured for interengagement enabling the seat to be attached to the sides. The flange and channel preferably have an arcuate configuration.

The means for anchoring may include track structure associated with the ground surface, for interengagement with rail structure formed on the sides. In addition, at least one of the spaced apart sides may include a holder for receiving articles such as drink cups, food stuffs, souvenirs, and other useful articles placed therein, and be outfitted with a headphone jack.

The inventive seat may also be summarized as follows: a modular stadium seat having a unitary seat component with a back formed integral therewith; spaced apart sides; and cooperating flange and channel means for operably attaching the seat to the spaced apart sides. The flange and channel means preferably has an arcuate configuration.

The inventive stadium may be summarized as follows: a stadium including an event area; and a plurality of spectator seats attached to a ground surface; wherein the seats are configured in accordance with the teachings set forth herein.

The foregoing summaries are not intended to be limiting, but merely exemplary of the scope of the present invention claimed herein.

DETAILED DESCRIPTION OF THE PREFERRED EMBODIMENT

Figure 1:
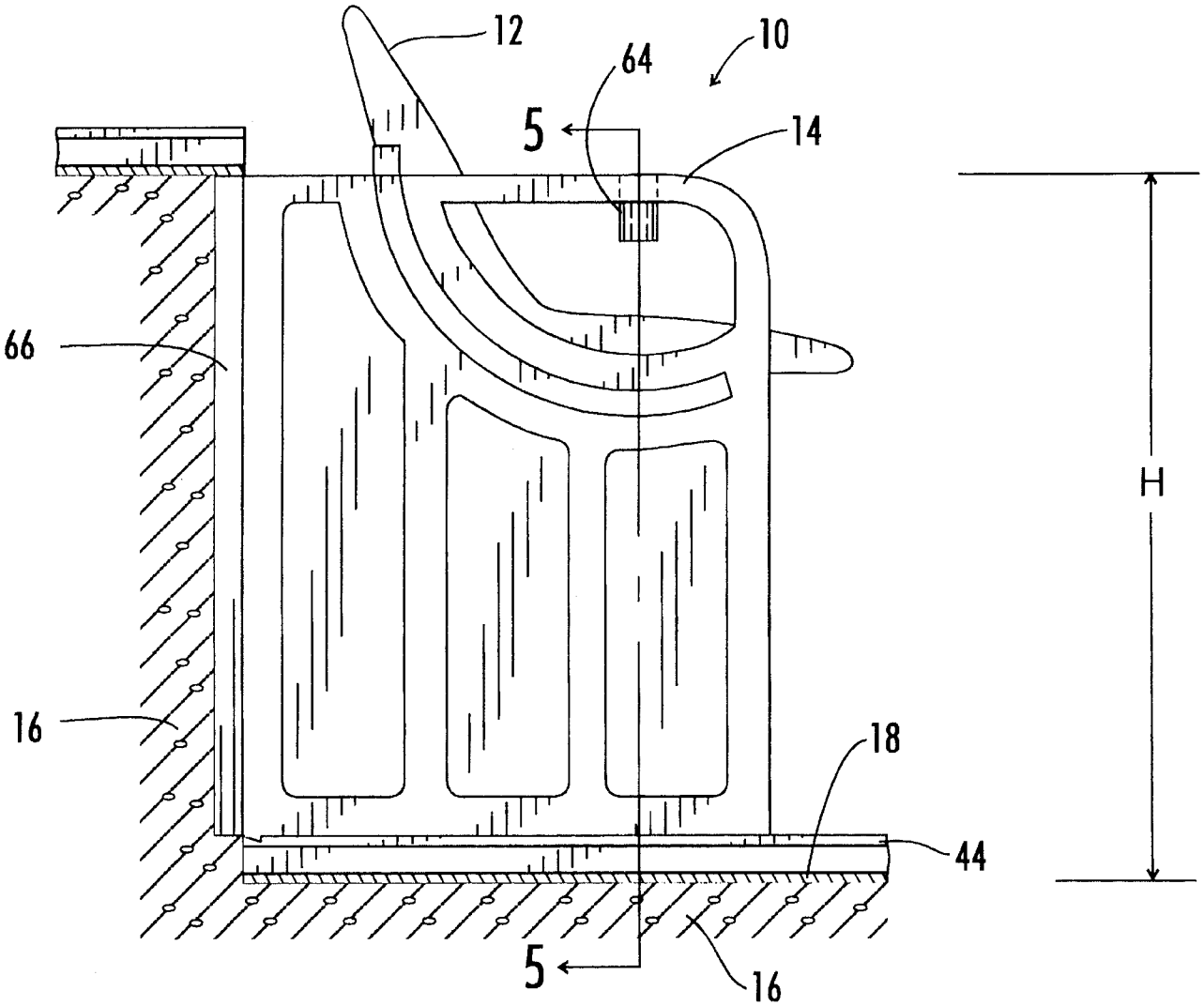
FIG. 1 is a side plan view of an embodiment of the present invention.

An embodiment of the present invention is designated generally by the reference numeral 10 in FIG. 1. Embodiment 10 includes a unitary seat component 12 and a pair of side supports 14 (only one side is visible) which are anchored to a support platform or ground surface structure 16, such as a concrete formation, by track structure 18 and 20.

Figure 2B:
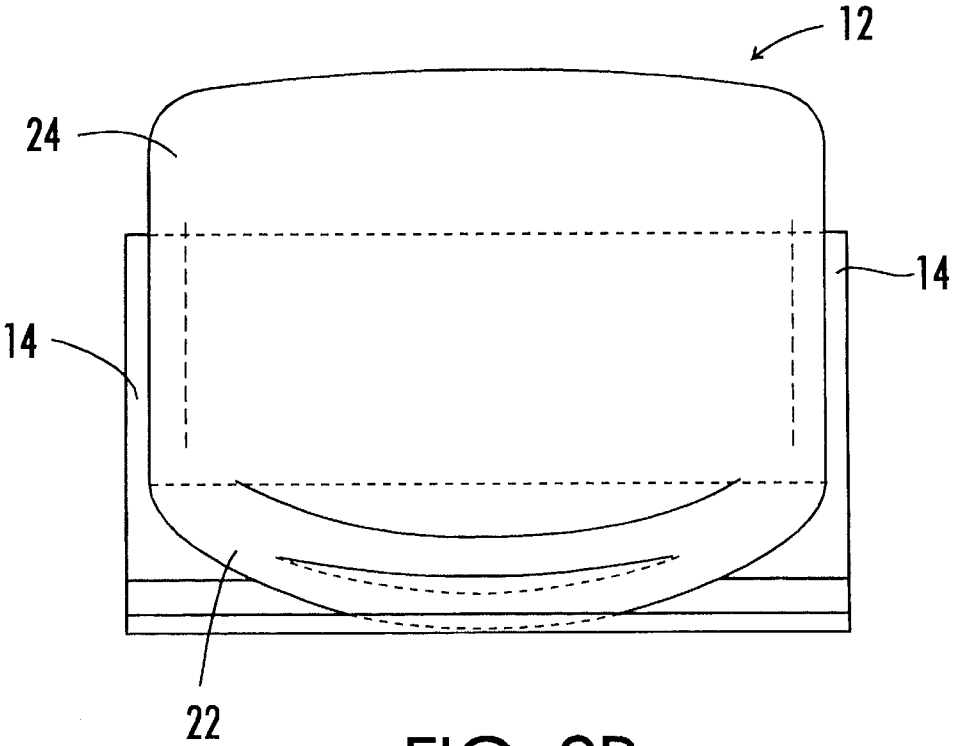
FIG. 2B is a top view of the seat shown in FIG. 2A.
Figure 2A:
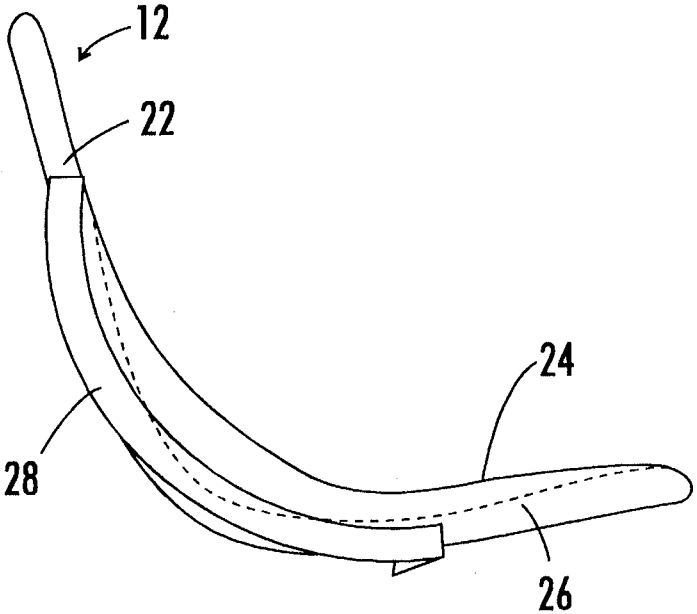
FIG. 2A is a side plan view of the unitary seat component of the embodiment of the invention shown in FIG. 1.

With reference to FIGS. 2A and 2B, seat component 12 is shown having a back portion 22, a lower platform portion 24, an edge 26, and an arcuate flange 28 integral with the edge 26.

Figure 3C:
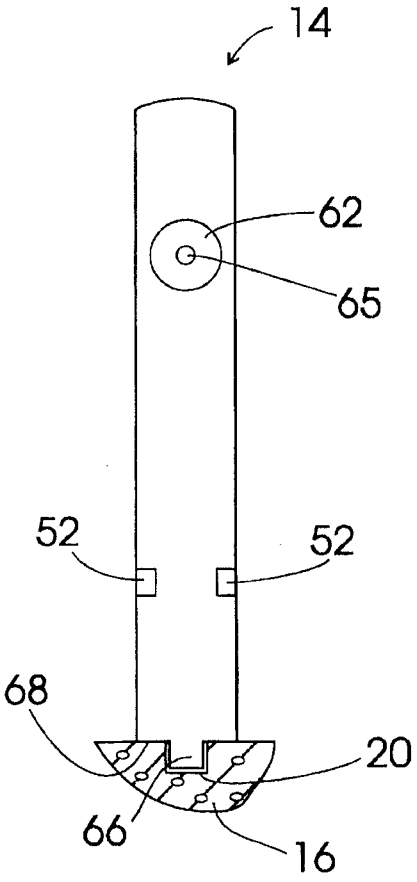
FIG. 3C is a top view of the side component as shown in FIG. 3A.
Figure 3B:
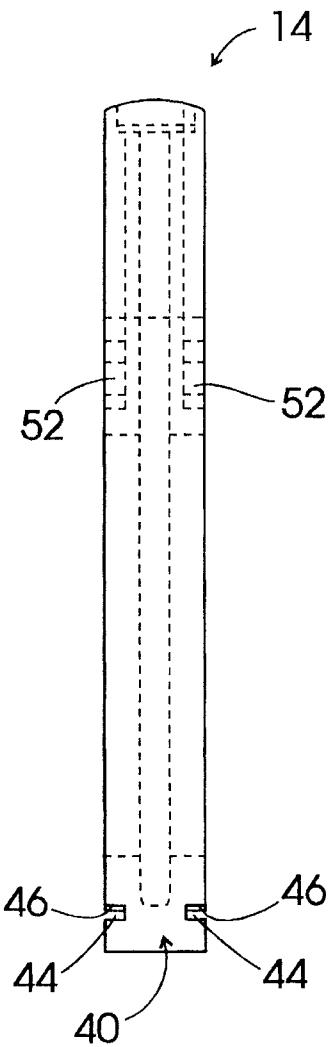
FIG. 3B is a front view of the side component shown in FIG. 3A.

With reference to FIGS. 3A, 3B, 3C, and 5, each side support member 14 has a horizontal armrest portion 30 with container 60, vertical back and front frame segments 32 and 34 respectively, and at least one vertical support 36 (the figure shows two supports) to provide added stability. In addition, a curved armrest portion 38 is positioned between the top rest 30 and vertical from 34 forming a rounded surface. With reference to FIGS. 3B and 6A, base 40 includes a runner 42, channel 44 and angled projection 46 configured to slidably engage track structure 18. Angled projection 46 has a shoulder surface 48 and a beveled surface 50.

Figure 3A:
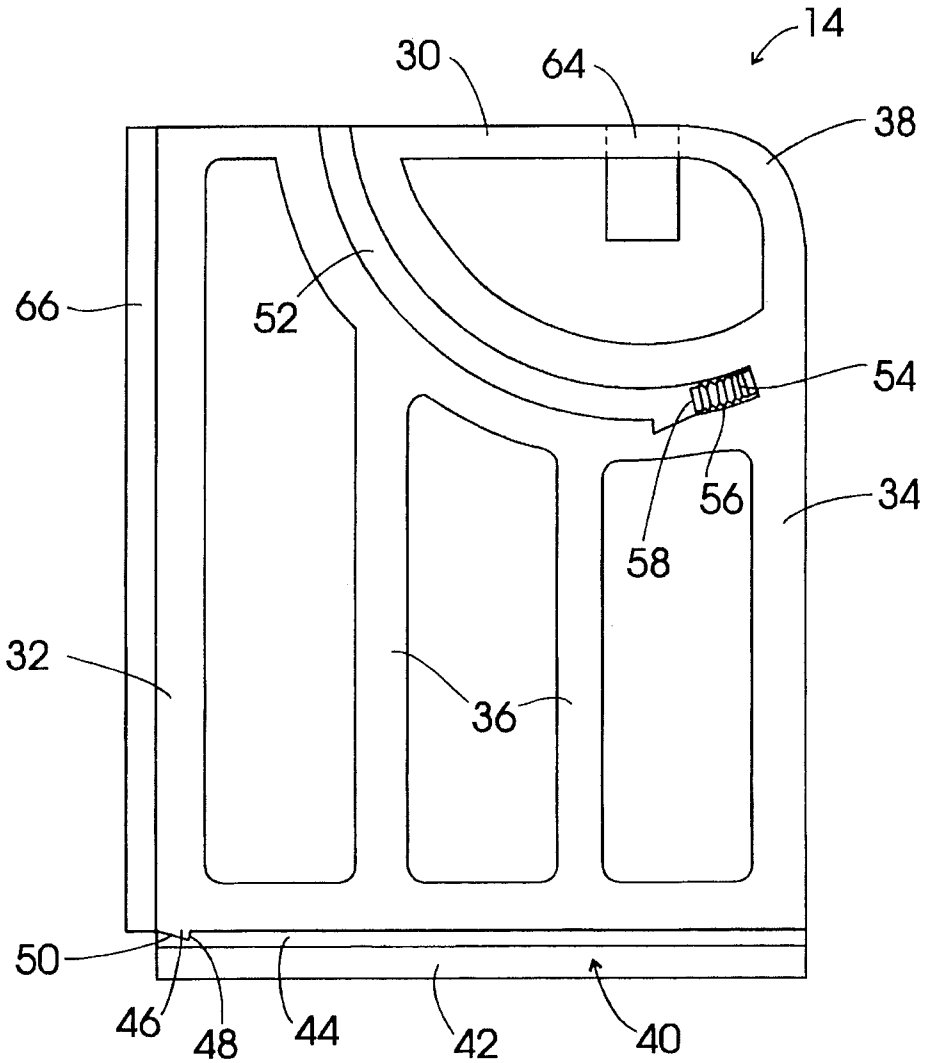
FIG. 3A is a side plan view of a side component of the embodiment shown in FIG. 1.

With reference to FIGS. 1 and 3A, projection 46 is provided to engage track structure 18 to prevent inadvertent disengagement of the sides 14 from a ground surface 16. Shoulder 48, therefore, engages a cooperating cut-away (not shown) of the track 18.

With reference to FIGS. 3A and 3C, arcuate channel 52 has a left and right configuration. The left and right configuration of the channel 52 with respect to a single side support 14 enables a seat component 12 to be engaged on either side of the support 14. Accordingly, a plurality of seats can be positioned between a plurality of side supports in an identical fashion to form a row of seats. Arcuate flange 28 and arcuate channel 52 are configured to cooperatively engage one another and enable the seat to be constrained therein. For example, three side components 14 will support two seat components 12.

With reference to FIGS. 3A through 3C, container 60, formed in armrest 30, includes opening 62, well 64 and drain 65. The container is particularly useful as a beverage or article storage compartment eliminating the need for the user of the seat to place a drink cup or other article under the seat or in the pathway traversed by other users of adjacent seats. In this fashion, the pathway remains uncluttered and the stadium incorporating such seating remains relatively neat and clean.

With reference to FIG. 3C, vertical flange 66 protrudes from the back surface 68 of the side support 14. Flange 66 is provided to engage a cooperatively configured track 20 (FIG. 3C). In this fashion, track 20 and flange 66 provide the torsional resistance necessary to maintain the side support 14 and attached seat component 12 in its installed position as shown in FIG. 1.

In the preferred embodiments, the back: 22 and platform portions 24 are contoured to provide a comfortable fit with respect to the natural curvature of the human body when a user is supported by seat component 12.

With reference to FIGS. 3A, and 4A–4C, biasing means 54 is positioned at the distal end of the arcuate channel 52. The biasing means applies an opposite force to the arcuate flange 28. When a user sits in the seat component 12, the users weight is sufficient to overcome the biasing force: associated with the biasing means 54. When the user removes his or her body weight from the seat 12, the biasing means causes the seat component 12 to deflect along the arcuate path of the channel 52 in a relatively upward direction enabling the contour of the seat portion 24 to have a downward slope. The downward slope prevents fluids and solid matter, including rain, snow, sleet, food, and drinks to accumulate on the seat portion 24. The amount of the deflection is preferably kept to a minimum in order to prevent the user from having: to "find the seat" after body weight is removed therefrom, such as when standing up.

Figure 4C:
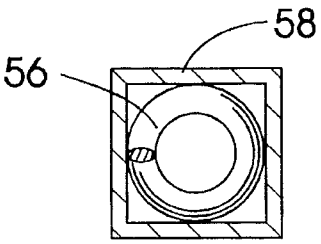
FIG. 4C is a cross-sectional end view taken along line C—C of FIG. 4B.
Figure 4B:
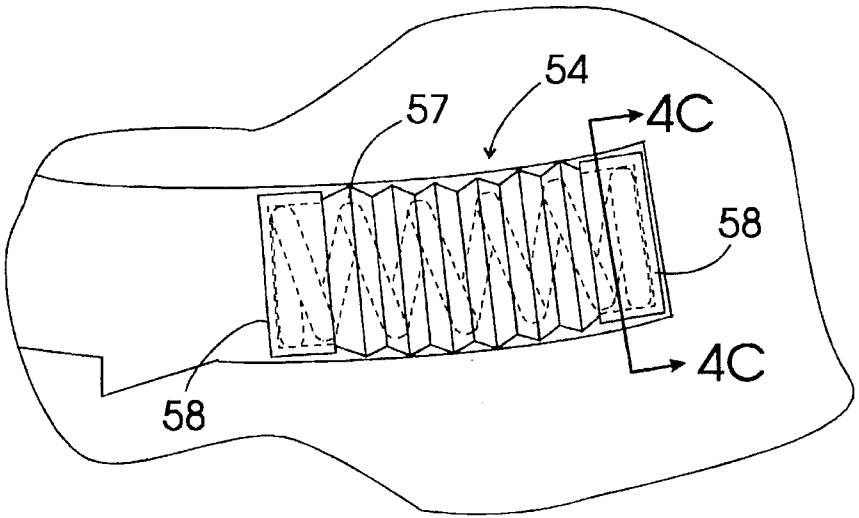
FIG. 4B is a side cross-sectional view of the biasing means shown in FIG. 4A.
Figure 4A:
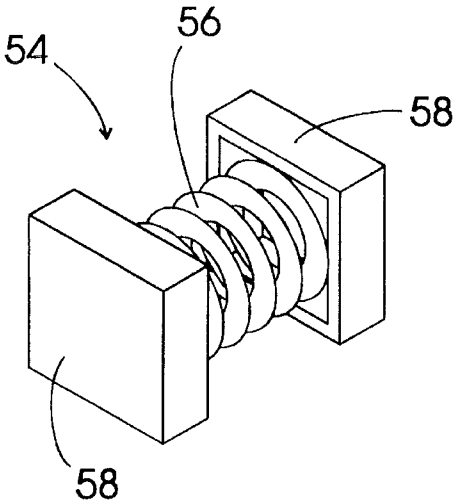
FIG. 4A is an elevated perspective view of an embodiment of the biasing means used in conjunction with the present invention.

Biasing means 54 may comprise a spring component 56 covered by a boot 57 and at its ends by a cap component 58 (FIGS. 4A–4C). Biasing may also be accomplished by flanged spring steel, resilient cushions, or any other suitable means of achieving the aforementioned results.

MODE OF OPERATION

Figure 5:
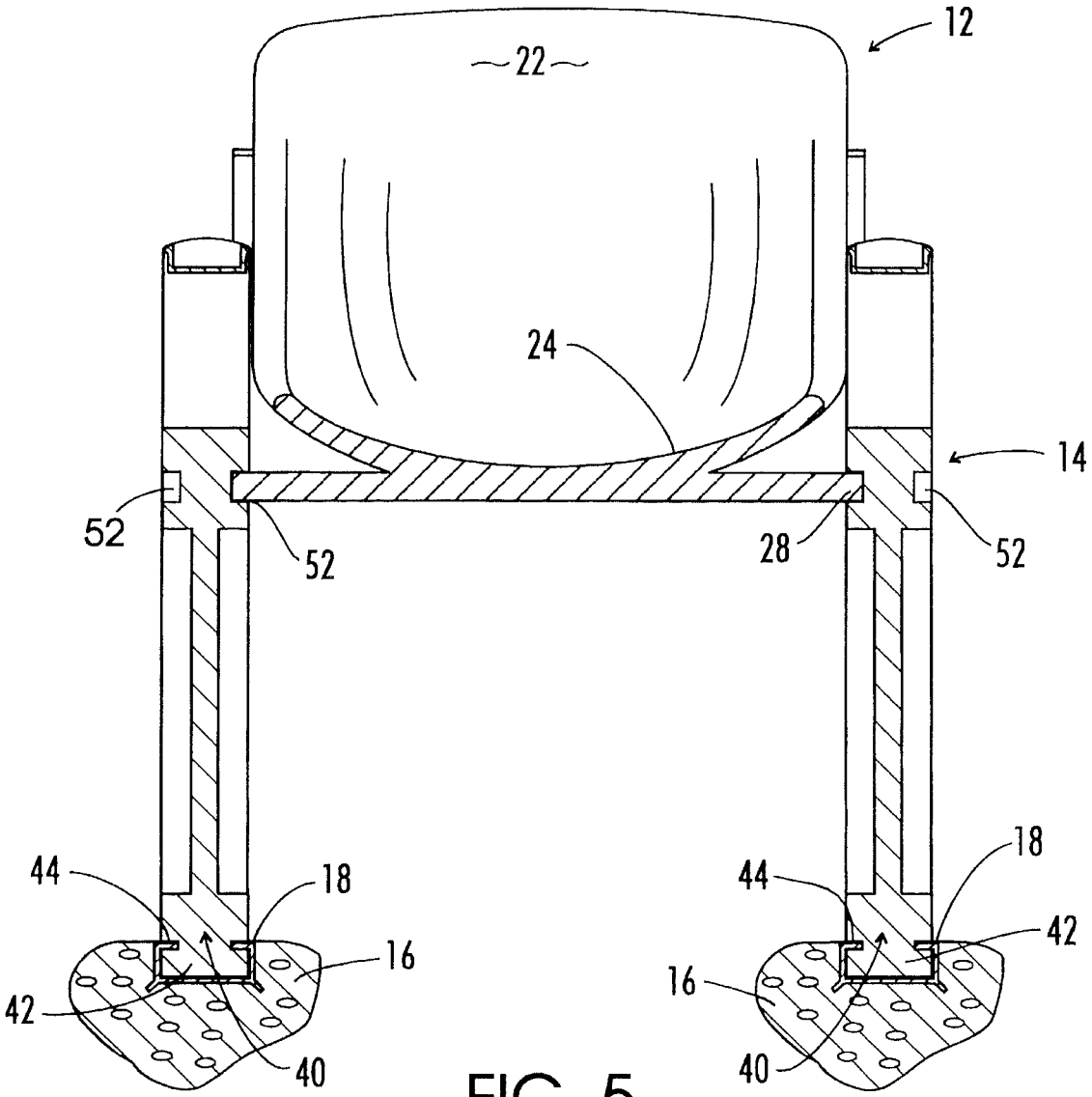
FIG. 5 is a front cross-sectional perspective view of the embodiment of the invention shown in FIG. 1, taken along line F5—F5 of FIG. 1.
Figure 6B:
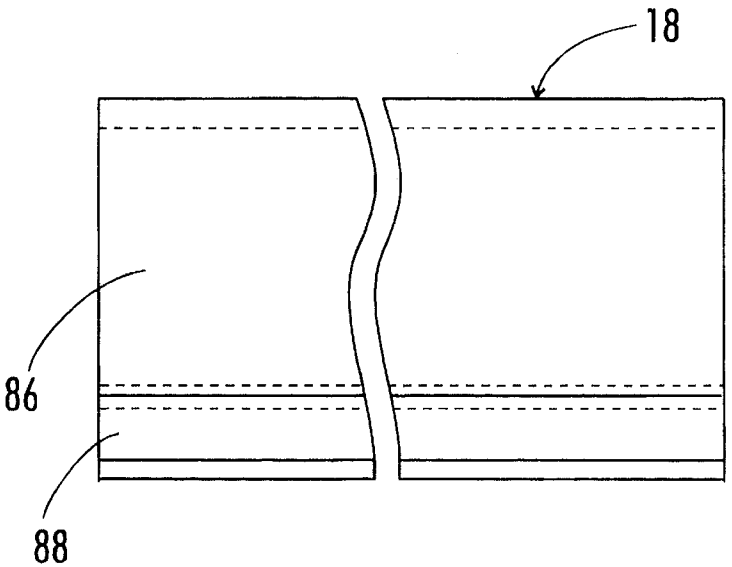
FIG. 6B is a side view of the anchoring means shown in FIG. 6A.
Figure 6A:
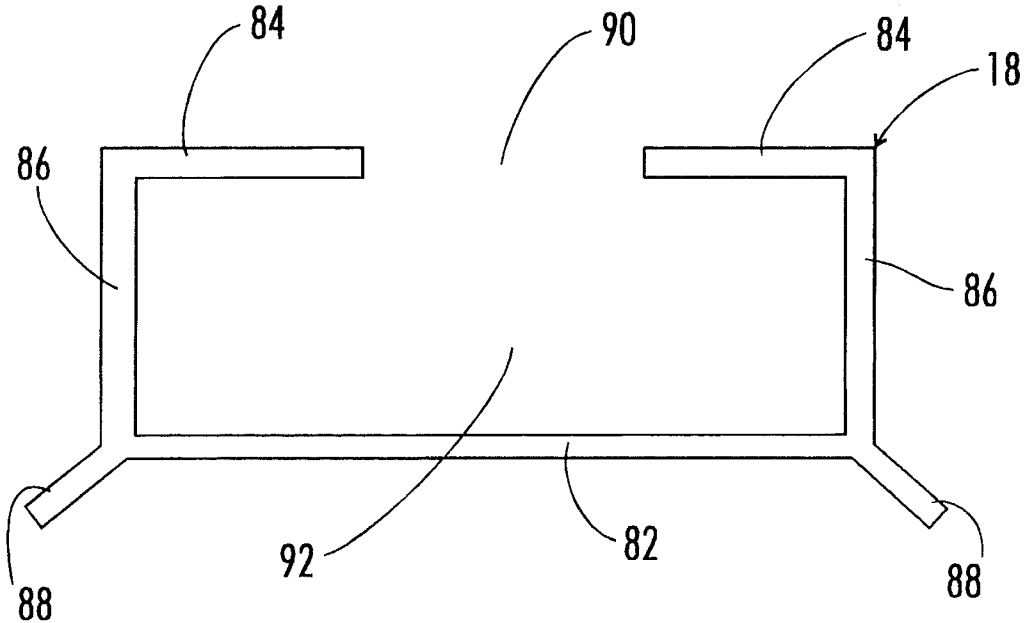
FIG. 6A is an end view of an embodiment of the anchoring means.
Figure 7A:
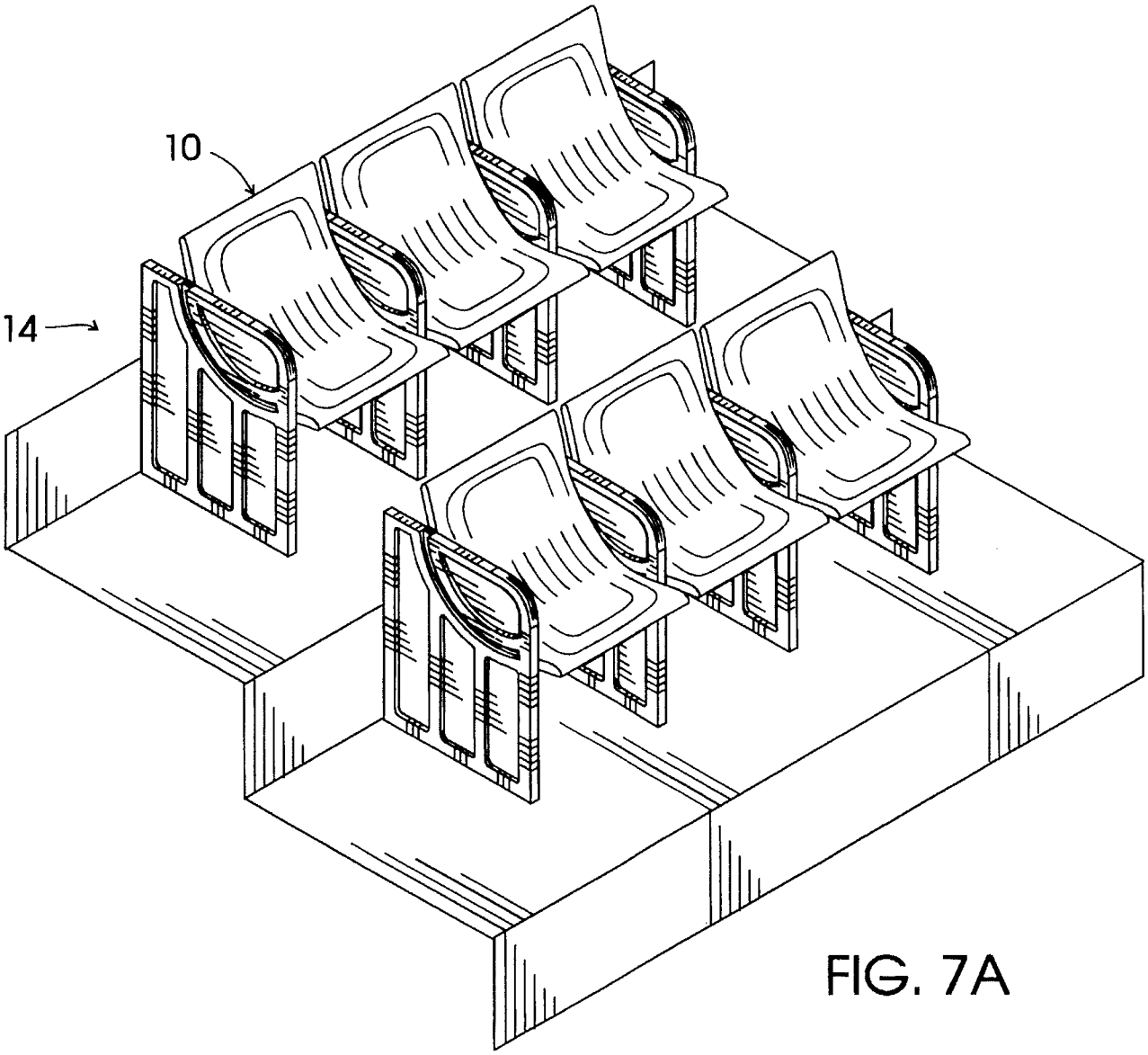
FIG. 7A is a perspective view of the invention.
Figure 7B:
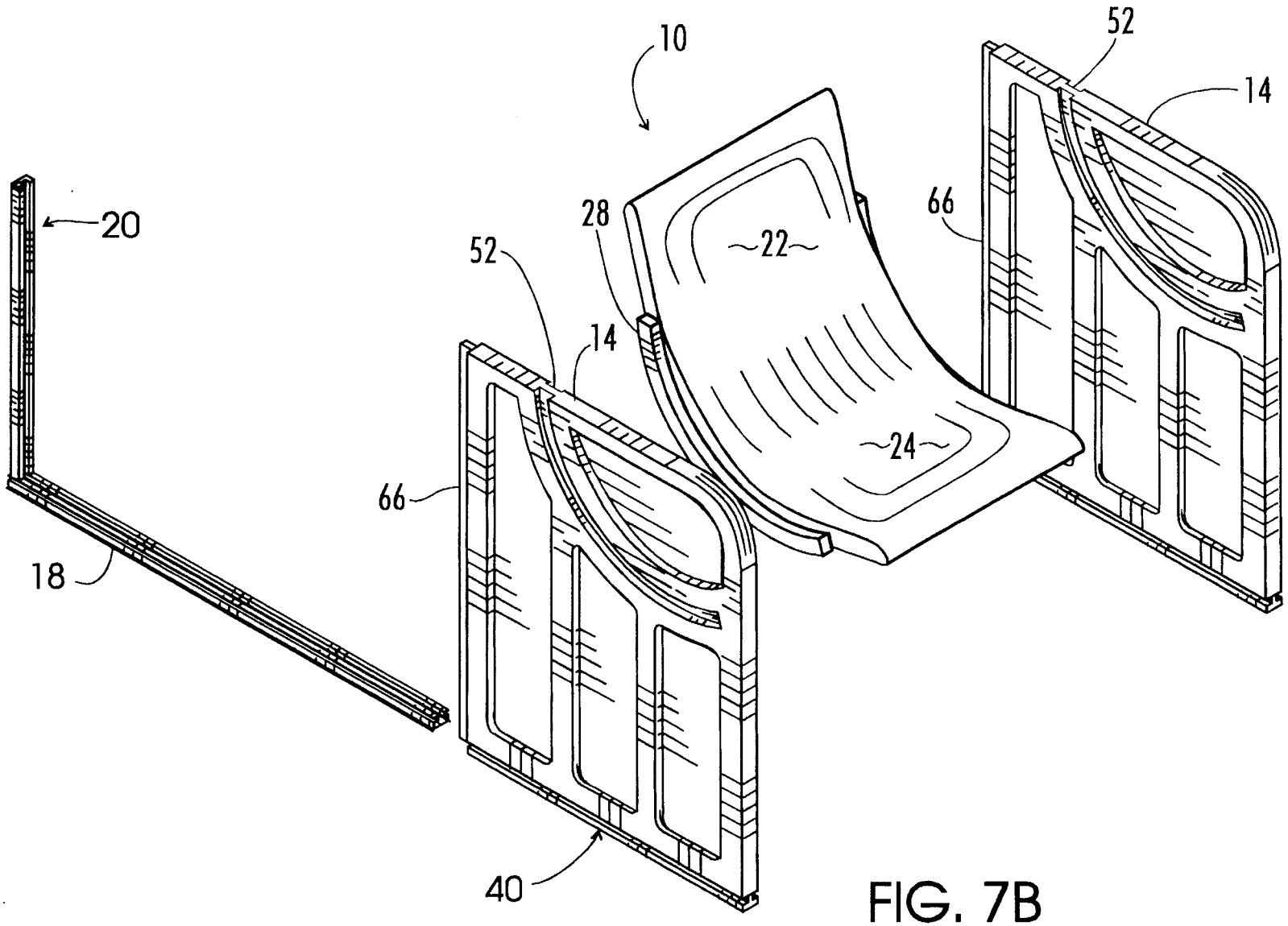
FIG. 7B is an exploded view of the invention.

With reference to FIGS. 5, 6A and 6B, the relative arrangement between the seat component 12 and the sides 14 with respect to the supporting ground structures 16 at vertical flange 66 and base 40 is found in the typical stadium setting. Arcuate flange 28 engages channel 52 to provide supporting communication of the seat 12 with the sides 14. Sides 14 are anchored to ground surface 16 by track structure 18.

With reference to FIGS. 6A and 6B, track structure 18 has a back 82, a front 84, sides 86, and angle projections 88 positioned between the back 82 and sides 86. Angle projections 88 are provided for additional support for the sides 14 when mounted to a concrete form in which track 18 is positioned (see FIG. 5). Front portions 84 engage the channel 44 of the sides 14. Accordingly, in the preferred embodiment, the channels 44 are sized to accommodate the front 84 of the track 18 and provide a snug communication therebetween. Opening 90 between front portions 24 and interior 92 enables the base 40 to be inserted therein. Accordingly, such communication provides a stable relationship between the ground surface 16, having track 18 mounted or rigidly attached thereto, which in turn enables the sides 14 to be adequately supported by the interengagement of the base 40 and track 18.

Track 18 and 20 are preferably constructed of an extruded aluminum or steel, and cut to length so as to correspond with the length L and the height H of side 14 respectively (see FIG. 1).

These and other embodiments of the present invention shall become apparent after consideration of the specification set forth herein. Any and all alternate embodiments and equivalents of such devices are believed to be contemplated and within the scope of the present invention whose only limitation is the constructed scope of the appended claims.

What is claimed is:

1. Modular stadium seating, comprising:

a seat having an integral back, an edge, and a flange extending from the edge;

spaced apart sides having a channel;

wherein the flange and the channel are cooperatively configured for slidable interengagement enabling the seat to be attached to the sides.

2. The stadium seating of claim 1, further including:

means for anchoring the combination of the seat and pair of spaced apart sides to a ground surface.

3. The stadium seating of claim 2, wherein the means for anchoring includes:

track means for engaging the spaced apart sides at a base.

4. The stadium seating of claim 1 wherein the flange and channel have an arcuate configuration.

5. The stadium seating of claim 1, wherein:

at least one of the spaced apart sides includes a holder.

6. The stadium seat of claim 1, further including:

biasing means at a distal end of the channel for tilting the seat.

7. The stadium seat of claim 6 wherein:

the biasing means comprises a spring having end caps and covered by a boot.

8. A modular stadium seat, comprising:

a seat component with a back formed integral therewith;

spaced apart sides; and cooperating arcuate flange and channel means for operably attaching the seat to the spaced apart sides.

9. The stadium seat of claim 8, further including:

means for anchoring the combination of the seat and pair of spaced apart sides to a ground surface.

10. The stadium seat of claim 9, wherein the means for anchoring includes:

a track structure.

11. The stadium seat of claim 8, wherein the tongue and groove means has an arcuate configuration.

12. The stadium seat of claim 8, wherein at least one of the spaced apart sides includes a holder for receiving articles.

13. The stadium seat of claim 8, further including:

biasing means positioned within a distal end of the channel for tilting the seat.

14. The stadium seat of claim 13, wherein:

the biasing means comprises a spring having end caps and covered by a boot.

15. A stadium, comprising:

an event areas; and a plurality of spectator seats attached to a ground surface; wherein the plurality of spectator seats have a seat component and a back component integral therewith and providing a continuous edge, spaced apart sides, and cooperating flange and channel means associated with the edge of the seat component and the spaced apart sides, for operably attaching the seat to the spaced apart sides.

16. The stadium of claim 15, further including:

means for anchoring the combination of the seat and pair of spaced apart sides to the ground surface.

17. The stadium of claim 15, wherein the means for anchoring includes:

track means for receiving the sides at a base.

18. The stadium of claim 15, wherein the tongue and groove means has an arcuate configuration.

19. The stadium seat of claim 15, wherein at least one of the spaced apart sides includes a holder for receiving articles.

20. The stadium of claim 15, further including:

biasing means positioned at a closed end of the channel for tilting the seat.

* * * * *